US008960810B2

(12) United States Patent
Fader

(10) Patent No.: US 8,960,810 B2
(45) Date of Patent: Feb. 24, 2015

(54) CUTTING BIT AND BIT HOLDER

(75) Inventor: Joseph Fader, Steiermark (AT)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 14/112,639

(22) PCT Filed: Feb. 20, 2012

(86) PCT No.: PCT/EP2012/052859
§ 371 (c)(1),
(2), (4) Date: Oct. 18, 2013

(87) PCT Pub. No.: WO2012/143153
PCT Pub. Date: Oct. 26, 2012

(65) Prior Publication Data

US 2014/0042795 A1 Feb. 13, 2014

(30) Foreign Application Priority Data

Apr. 20, 2011 (EP) ..... 11163236

(51) Int. Cl.
*E21C 35/197* (2006.01)
*E21C 35/19* (2006.01)

(52) U.S. Cl.
CPC ..... *E21C 35/19* (2013.01)
USPC ..... 299/110

(58) Field of Classification Search
USPC ..... 299/100–111, 112 R, 112 T, 113
See application file for complete search history.

(56) References Cited

U.S. PATENT DOCUMENTS

| | | | | |
|---|---|---|---|---|
| 3,331,637 | A * | 7/1967 | Krekeler | 299/107 |
| 3,342,531 | A * | 9/1967 | Krekeler | 299/107 |
| 3,932,952 | A | 1/1976 | Helton | |
| 5,261,499 | A * | 11/1993 | Grubb | 299/107 |
| 8,322,796 | B2 * | 12/2012 | Hall et al. | 299/106 |
| 2008/0309148 | A1 * | 12/2008 | Hall et al. | 299/104 |
| 2010/0244545 | A1 * | 9/2010 | Hall et al. | 299/105 |

FOREIGN PATENT DOCUMENTS

| | | | |
|---|---|---|---|
| EP | 0819208 | A1 | 1/1998 |
| FR | 2327389 | A * | 6/1977 |
| GB | 1568992 | A * | 6/1980 |

* cited by examiner

*Primary Examiner* — Sunil Singh
(74) *Attorney, Agent, or Firm* — Corinne Gorski

(57) ABSTRACT

A cutting bit for use in a heavy-duty mining, drilling or milling operation includes a generally conical body, a first end of which presents a cutting point and a second end of which presents an axially extending recess. The body has a generally convex surface portion. Locking means releasably and rotatably connect the cutting bit to a protruding part of a bit holder. The recess has an entrance portion presenting a generally conical surface portion. A corresponding bit holder is presented as well as a system using the cutting bit and bit holder.

13 Claims, 4 Drawing Sheets

CUTTING BIT AND BIT HOLDER

RELATED APPLICATION DATA

This application is a §371 National Stage Application of PCT International Application No. PCT/EP2012/052859 filed Feb. 20, 2012 claiming priority of EP Application No. 11163236, filed Apr. 20, 2011.

TECHNICAL FIELD

The present disclosure relates to a rotatable bit and a bit holder for use in a heavy-duty mining or drilling apparatus or in a road milling apparatus.

The disclosure particularly relates to so-called "pick type bits".

BACKGROUND

In e.g. mining, drilling or road milling applications, a drive body, which may have the form of e.g. a drum or a drill head, is provided with a number of replaceable bits, which present a very hard cutting point. Non-limiting examples of such drive bodies are shown in FIGS. 1 and 14-20 of U.S.2008/258536A1.

The bit shown in U.S.2008/258536A1 comprises a head portion, which may be approximately conical and taper towards a cutting point; and a shank, which is insertable into a bit holder. The bit is a wear part, and hence it is desirable to be able to rapidly replace worn bits, and also to produce such bits at as low cost as possible.

The bit holder is, in turn, fixedly connected to the drive body. The functions of the bit holder are to ensure that the bit is angled in the desired direction and to replaceably receive the bit. The bit holder may be integrated with the drive body, it may be formed in one piece with the drive body, or it may be attached to the drive body. The bit holder may protrude more or less from the surface of the drive body.

U.S. Pat. No. 5,261,499 discloses a drill bit, which is designed according to the principles set forth above, and where the head portion of the bit is rotatable relative to the shank, which serves to distribute wear more evenly over the head portion.

U.S. Pat. No. 3,342,531 discloses various drill bit designs, which provide strictly conical bit heads, which are attachable on a shank, which is in turn attachable to a bit holder.

U.S. 2008/0309148A1 shows a bit design according to the pre-characterizing portion of claim 1.

There is a general need for improvements in cutting bit and bitholder designs.

SUMMARY

It is a general object of the present disclosure to provide a cutting bit concept, which provides improved durability and which can be produced at a lower cost.

The invention is defined by the appended independent claims. Embodiments are set forth in the dependent claims, in the following description and in the drawings.

According to a first aspect, there is provided a single tip cutting bit for use in a heavy-duty mining, drilling or milling operation. The cutting bit comprises a generally conical body, a first end of which presenting a cutting point and a second end of which presenting an axially extending recess, presenting a generally convex surface portion and having locking means for releasably and rotatably connecting the cutting bit to a protruding part of a bit holder. The recess has an entrance portion presenting a generally conical surface portion. The generally convex surface portion comprises an axially rounded convex surface.

The term "generally conical" should be construed to include also frustoconical bodies, and other bodies which are rotationally symmetrical, or approximately so, with a generally conical cross section.

The "entrance portion" is a portion which is situated inside the recess, at the second end of the conical body, and which is designed to be active in force transfer between the bit and the bit holder.

The axially rounded convex surface is defined in an axial cross-section through the bit, such as in FIG. 6.

The rotatable connection may be so conceived that the bit and bit holder are rotatable relative to each other when the bit is subjected no or a relatively small load, while the bit and bit holder may not be rotatable relative to each other upon being subjected to greater loads. Between cuts, there may be a relatively loose contact, or even a small play between the interacting conical/convex surfaces and/or conical surfaces.

The convex surface portion and the conical entrance portion provide for effective load transmission. In particular, the interaction between conical and convex/concave surfaces provides for improved absorption of impact loads through the tapered surfaces, with increased resistance to shear loads. The claimed geometry also operates to self-center the bit onto the bit holder, which is advantageous from a force transfer perspective. Finally, the disclosed design allows for a larger protruding part without having to weaken the bit by too much removal of material.

The locking means may be spaced inwardly from an opening of the recess.

The convex surface portion may be positioned between the locking means and an opening of the recess. For example, the convex surface portion may be positioned between the conical surface portion and the locking means.

A distance from a base of conical body to an innermost portion of the locking means is less than or equal to half a total height of the generally conical body.

A radius of the convex surface portion is greater than or equal to ¼ of a distance from a base of the conical body to an innermost portion of the locking means.

A radius of the convex surface portion is less than or equal to twice a distance from a base of the conical body to an innermost portion of the locking means.

An outer surface portion of the conical body may be generally concave.

The locking means may comprise a bearing. Hence, relative rotational movement is facilitated.

The generally conical body may be formed mainly of steel and/or carbide.

The cutting point may be at least coated with a super hard material, or a combination of super hard materials. The cutting point may thus be formed partly or entirely of the super hard material or materials.

Super hard materials may be defined as materials having a hardness value exceeding 40 GPa (gigapascals) when measured by the Vickers hardness test, and include, but are not limited to, diamond, cubic boron nitride, carbon nitrides and aggregated diamond nanorods.

According to a second aspect, there is provided a bit holder for a cutting bit. The bit holder comprises a holder body, a protruding part, extending from the holder body, and being adapted to extend into a recess of a cutting bit as claimed in any one of the preceding claims, and locking means positioned on the protruding part for releasably locking the cutting bit to the bit holder. The protruding part presents a concave surface portion, adapted for abutment against the convex surface portion of the cutting bit. The holder has a shoulder portion presenting a generally conical surface portion, for interaction with the entrance portion of the cutting bit. The concave surface portion comprises an axially rounded concave surface.

The axially rounded concave surface is defined in an axial cross-section through the bit, such as in FIG. 6.

The "holder body" is a body which attaches in a relatively permanent manner to a drive body, and which receives the more easily replaceable cutting bit.

The "shoulder portion" is a portion which is situated at the transition from the protrusion to the holder body, and which thus presents an outwardly facing conical surface portion. The concave surface portion provides for effective load transmission.

The bit holder may be adapted for being permanently secured to a drive body.

The protruding part and the holder body are formed in one piece.

The one piece arrangement provides increased resistance against fatigue, as compared with an arrangement where the protruding part is formed of a separate part, which is attached to the holder body.

According to a third aspect, there is provided a system comprising a cutting bit as described above and a bit holder as described above. A second end of the cutting bit may extend radially beyond a bit facing surface of the bit holder.

The entrance portion may extend axially beyond the shoulder portion when the cutting bit is connected to the bit holder.

Through the extent of the bit, protection is provided for the bit facing surface, and also for the entire joint between the bit holder and the bit, since the risk of dust and fines entering into the joint and interfering with its ability to allow for a relative rotational movement is decreased.

DESCRIPTION OF EMBODIMENTS

Figure 1:
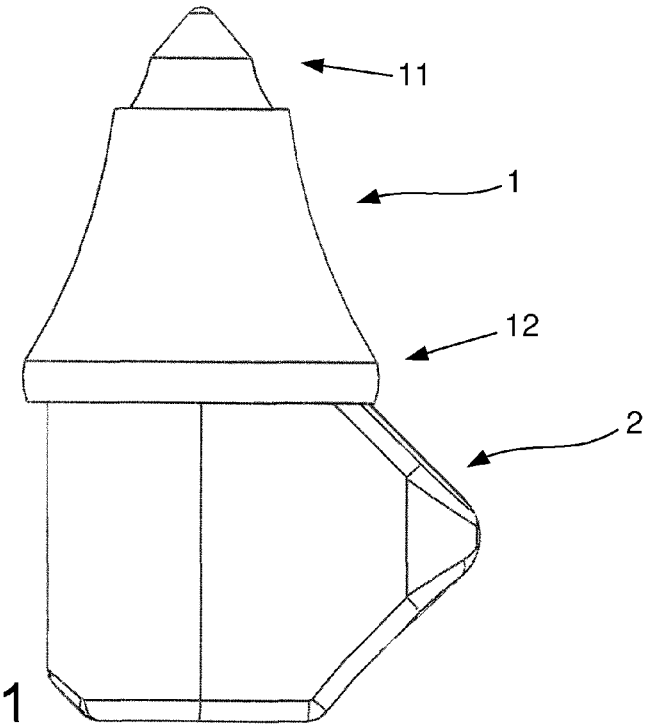
FIG. 1 schematically illustrates a cutting bit and a bit holder.
Figure 2:
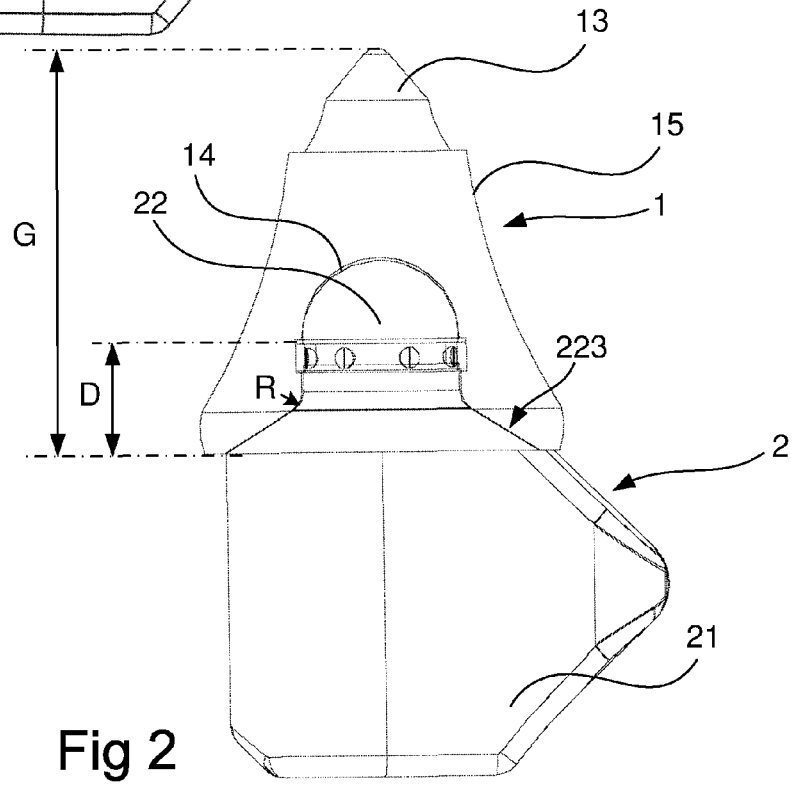
FIG. 2 is a schematic sectional view of the cutting bit and bit holder in FIG. 1.

FIGS. 1 and 2 illustrate a pick system, comprising a cutting bit 1 and a bit holder 2. At a first end 11, the cutting bit has a cutting point 13, and at a second end 12, the cutting bit presents an axially extending recess 14, which is adapted for receiving a protrusion 22 forming part of the bit holder 2.

A cutting bit body 15 may be formed of e.g. steel, carbide or any other hard material. The cutting point 13 may be formed of carbide with a wear layer of a super hard material, such as diamond, polycrystalline diamond or cubic boron nitride, or only of the super hard material.

The bit holder 2 may comprise a holder body 21, which may be formed of steel and presenting a protrusion 22, which is adapted for receiving the cutting bit 1. The protrusion and the holder body may be formed in one piece. The bit holder is adapted to be connected to a drive body, such as a drum or a drill head, in a relatively permanent manner. The term "permanent" here does not exclude that the bit holder is removable from the drive body without destroying either of them.

Referring to FIG. 2, an axial distance D from a base surface 18 of the conical body to an innermost portion of the groove forming part of the locking device 19 may be less than or equal to half a total height G of the generally conical body, including the cutting point.

Moreover, a radius R of the convex surface portion may be greater than or equal to about ¼ of a distance D from the base surface 18 of the conical body to an innermost portion of the groove forming part of the locking device 19.

A radius R of the convex surface portion may be less than or equal to twice a distance D from a base surface 18 of conical body to an innermost portion of the groove forming part of the locking device 19.

The bit holder may have a bit facing surface 223, which is defined as the surface of the bit holder, which coincides with an axial projection of the recess onto the bit holder. Hence, the bit facing surface is generally annular. The bit facing surface faces the recess of the bit and may be positioned closer to the holder body than the locking means. A part of the bit facing surface may be concave to mate with the convex surface described above.

At least a portion of the second end 12 of the bit may extend axially so far as to axially coincide entirely with the bit facing surface when the protruding part is completely received in the recess. In another embodiment, the second end 12 extends so far as to coincide entirely with the bit facing surface over an annular segment of the bit facing surface when the protruding part is completely received in the recess.

The second end 12 may also extend axially beyond the bit facing surface, either entirely or over an annular segment of the bit facing surface when the protruding part is completely received in the recess.

The base surface 18 may be substantially annular and continuous, i.e. free from axial slits.

Figure 3A:
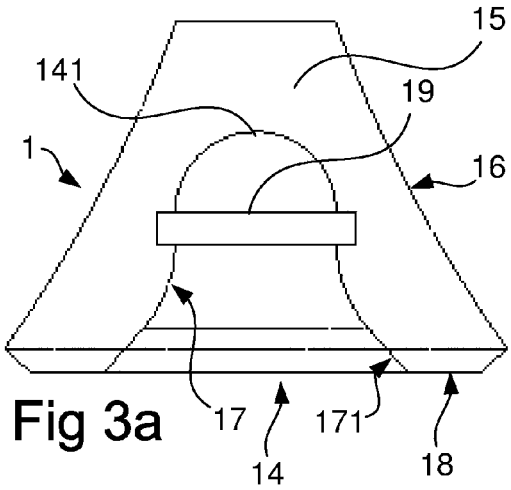
FIGS. 3*a*-3*b* schematically illustrate a first embodiment of a cutting bit, with the cutting point being removed.
Figure 3B:
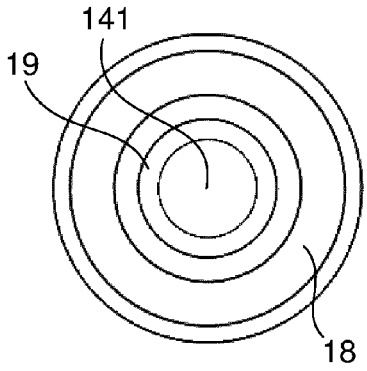
Figure 6:
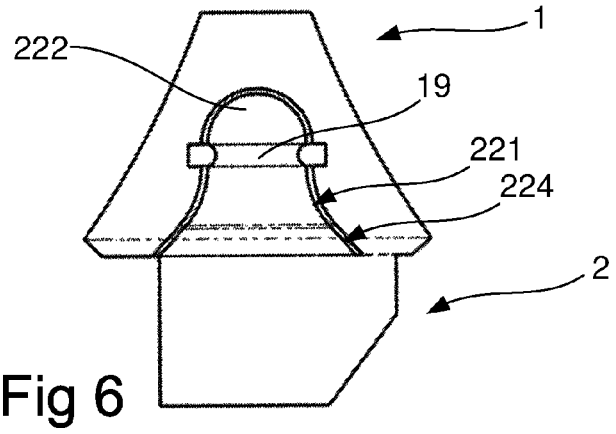
FIG. 6 is a schematic sectional view of a first embodiment of a cutting bit and bit holder, with the cutting point being removed.

FIGS. 3*a*-3*b* and 6 illustrate a first embodiment of a cutting bit 1 and a bit holder 2.

The cutting bit 1 has a generally conical, or frusto-conical body 15, the envelope surface of which having a convex surface portion 16, or being substantially convex in its entirety. The body 15 may be substantially symmetrical.

The cutting bit 1 presents a recess 14 starting at a base surface 18 and extending axially into the body 15 and ending at a recess bottom 141, which in this embodiment is substantially hemispherical. A locking device 19 is positioned in the recess 14.

The locking device 19 may comprise a circumferential groove, in which a locking ring may be arranged. The locking ring may be resilient. Its periphery may be continuous or discontinuous, e.g. crenellated. The locking device may be designed to provide a sufficient gap to allow a rotational movement between the bit and the bit holder once the locking device has been activated to connect a bit 1 to a bit holder 2.

The locking device may comprise at least one part arranged on the cutting bit and one part arranged on the bit holder. For example, the locking means may comprise one or more locking protrusions, which are to be received in a complementary locking recess. The locking protrusion may be formed in one piece with either the cutting bit or the bit holder, or they may be provided in the form of a separate part, which is initially mounted on the bit holder or in the cutting bit.

Starting at the locking device 19 and extending towards, or all the way to, the base surface 18, there is a transition surface 17, which may present a convex surface portion (as seen in cross section), or which may be convex in its entirety.

At the lowermost part of the recess 14, there is an entrance portion 171, which is generally conical.

Referring to FIG. 6, the bit holder may have a shape which is complementary to that of the recess 14, with a small gap allowing for relative rotational movement between the bit and the bit holder. For example, the protrusion may have a substantially hemispherical distal end 222, a locking device, which may be formed as a circumferential groove, and a transition surface 221, adapted for interaction with the transition surface 17, and thus presenting a generally concave surface portion extending from the locking device.

Figure 4A:
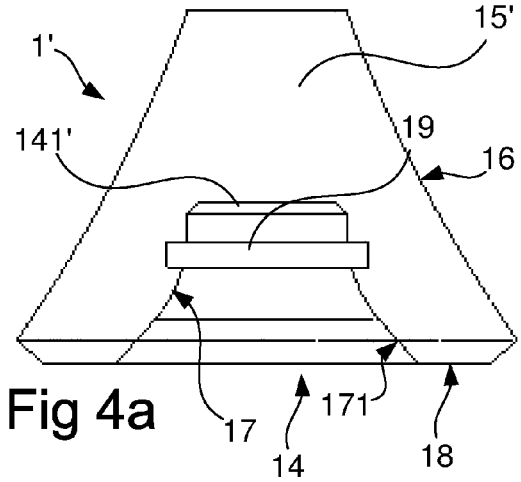
FIGS. 4*a*-4*b* schematically illustrate a second embodiment of a cutting bit, with the cutting point being removed.
Figure 4B:
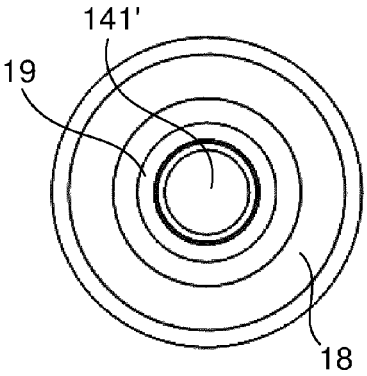
Figure 7:
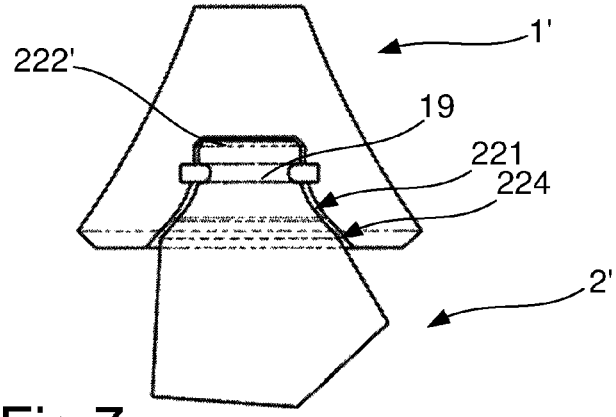
FIG. 7 is a schematic sectional view of a second embodiment of a cutting bit and bit holder, with the cutting point being removed.

FIGS. 4*a*-4*b* and 7 illustrate a second embodiment of a cutting bit 1' and a bit holder 2'.

The cutting bit 1' has a generally conical, or frusto-conical body 15', the envelope surface of which having a convex surface portion 16, or being substantially convex in its entirety. The body 15' may be substantially symmetrical.

The cutting bit 1' presents a recess 14 starting at a base surface 18 and extending axially into the body 15' and ending at a recess bottom 141', which in this embodiment is substantially flat with chamfered edges. A locking device 19 is positioned in the recess 14. The locking device 19 may comprise a circumferential groove, in which a locking ring may be arranged. The locking ring may be resilient.

Starting at the locking device 19 and extending towards, or all the way to, the base surface 18, there is a transition surface 17, which may present a convex surface portion (as seen in cross section), or which may be convex in its entirety.

Referring to FIG. 7, the bit holder 2' may have a shape which is complementary to that of the recess 14, with a small gap allowing for relative rotational movement between the bit and the bit holder. For example, the protrusion may have a substantially flat distal end 222', with chamfered edges; a locking device, which may be formed as a circumferential groove, and a transition surface 221, adapted for interaction with the transition surface 17, and thus presenting a generally concave surface portion extending from the locking device.

Figure 5A:
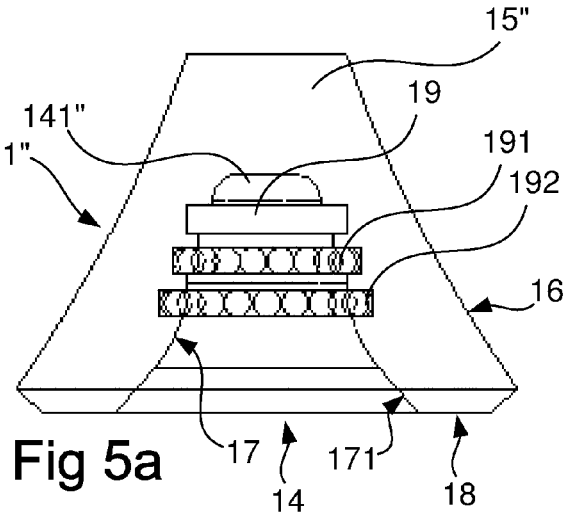
FIGS. 5*a*-5*b* schematically illustrate a third embodiment of a cutting bit, with the cutting point being removed.
Figure 5B:
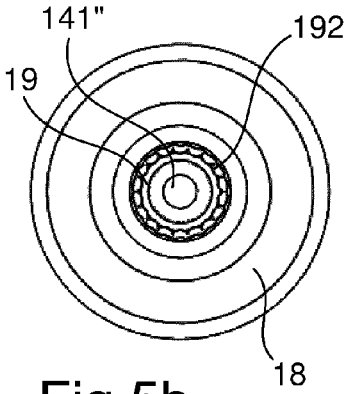
Figure 8:
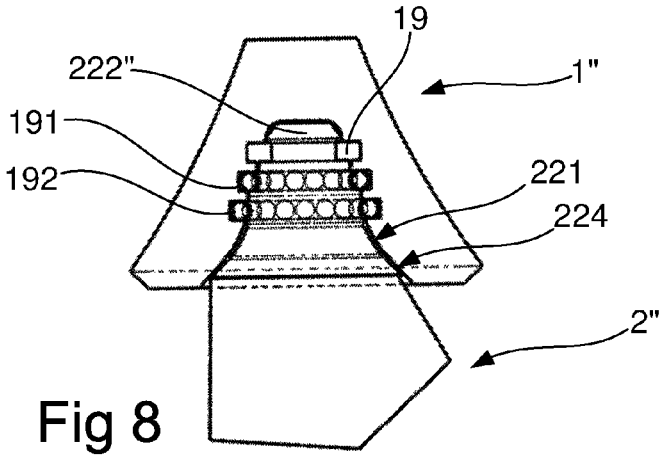
FIG. 8 is a schematic sectional view of a third embodiment of a cutting bit and bit holder, with the cutting point being removed.

FIGS. 5*a*-5*b* and 8 illustrate a third embodiment of a cutting bit 1" and a bit holder 2".

The cutting bit 1" has a generally conical, or frusto-conical body 15", the envelope surface of which having a convex surface portion 16, or being substantially convex in its entirety. The body 15" may be substantially symmetrical.

The cutting bit 1 presents a recess 14 starting at a base surface 18 and extending axially into the body 15" and ending at a recess bottom 141", which in this embodiment is substantially flat with rounded edges. A locking device 19 is positioned in the recess 14. The locking device 19 may comprise a circumferential groove, in which a locking ring may be arranged. The locking ring may be resilient.

One or more bearings 191, 192, which may be in the form of ball bearings, are provided between the locking device 19 and the base surface 18. The Starting at the locking device 19 and extending towards, or all the way to, the base surface, there is a transition surface 17, which may present a convex surface portion (as seen in cross section), or which may be convex in its entirety. The convex transition surface may, as an alternative, originate at the lowermost bearing 192 and extend towards, or all the way to, the base surface 18.

The bearings 191, 192 may comprise a plurality of balls and a ball holder, as is conventional in ball bearing technology. The bearing or bearings 191, 192 may be provided in addition to, or instead of, the locking device 19.

Referring to FIG. 8, the bit holder 2" may have a shape which is complementary to that of the recess 14, with a small gap allowing for relative rotational movement between the bit and the bit holder. For example, the protrusion may have a substantially flat distal end 222", with rounded edges; a locking device, which may be formed as a circumferential groove, and a transition surface 221, adapted for interaction with the transition surface 17, and thus presenting a generally concave surface portion extending from the locking device. The protrusion 22" may further have one or more bearing grooves adapted for receiving the bearings arranged in the recess 14" of the bit 1".

Figure 9:
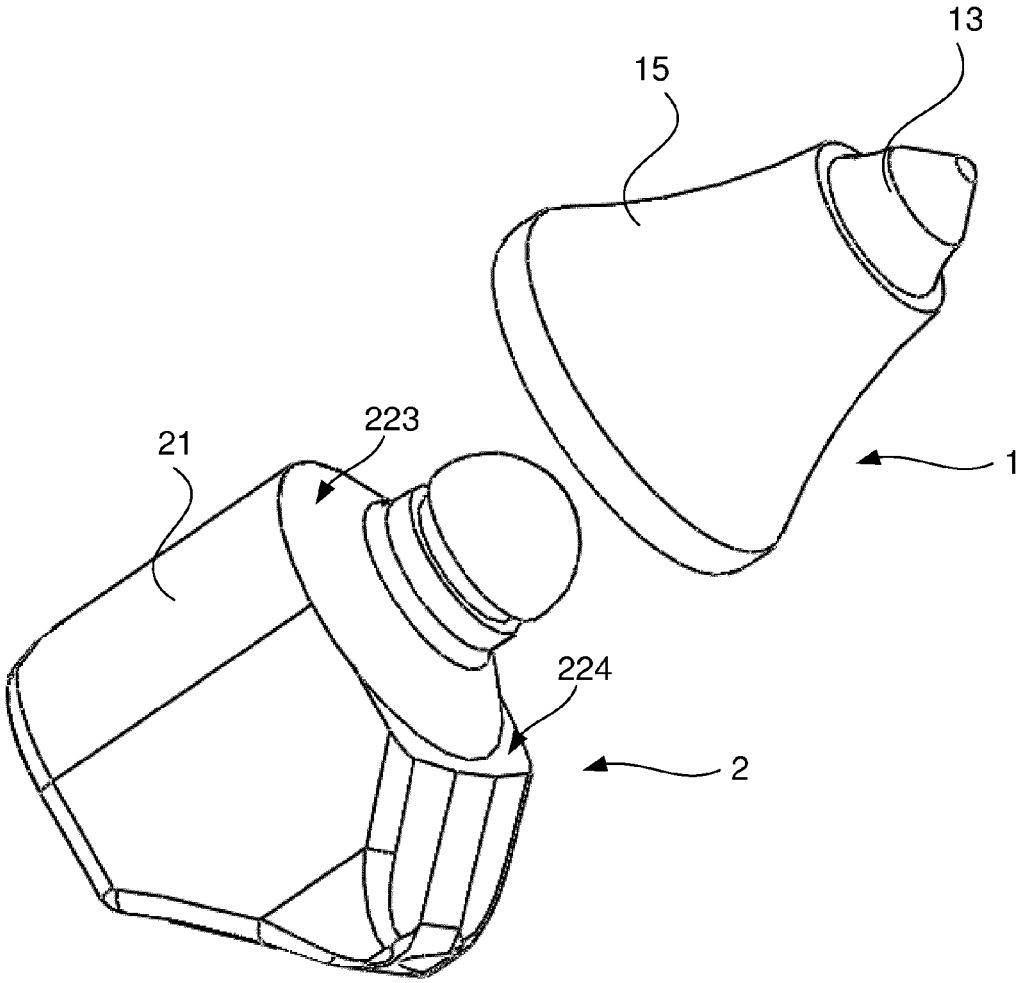
FIG. 9 is a schematic perspective view of the cutting bit and bit holder.

As disclosed in FIG. 9, the holder may present a bit facing surface 223, 224, comprising one part 223 which may be conical for interaction with the conical surface of the entrance portion of the bit recess 14 and one part 224 which may be generally flat.

In another embodiments (FIGS. 7, 8), the bit holder 2', 2" presents only the conical surface 223, and no such generally flat part.

In the disclosed embodiments, annular grooves are provided on protruding part 22 of the bit holder and in the recess 14 of the cutting bit. However, other locking device arrangements are not excluded.

It is noted that bearings may be connected to the recess 14" of the bit or to the protrusion 22". An advantage of connecting the bearings to the recess 14" would be that they are replaced every time the bit 1" is replaced. An advantage of connecting the bearings to the protrusion 22" is that they would then be reused, thus reducing the complexity and cost of the bit 1".

The bearing or bearings may form part of, or entirely constitute, the locking device.

It is conceivable, though currently not claimed, to provide an embodiment having the one piece protruding part 22 and holder body 21, but without the concave/convex surfaces 17, 221 or without the generally conical surface portion 171, 223.

It is also conceivable, though currently not claimed, to provide an embodiment having the bit protecting the bit facing surface 223, 224 without concave/convex surfaces 17, 221, without having the entrance portion presenting a generally conical surface portion or without having the one piece protruding part 22 and holder body 21.

Finally, it is conceivable to provide the cutting bit, at its second end 12 with a skirt (not shown) extending axially from the base surface 18 and enclosing at least part of the holder, thereby providing additional protection of the holder and in particular the holder's interface with the cutting bit. The skirt may be formed in one piece with the bit or by a separate part which is attached to the bit body, and it may extend all the way around the recess 14. There may be a radial gap between an innermost surface of the skirt and the holder. The skirt may be designed not to participate in the transfer of forces from the bit to the bit holder.

The invention claimed is:

1. A single tip cutting bit for use in a heavy-duty mining, drilling or milling operation, comprisinga generally conical body, a first end of which forming a cutting point and a second end of which forming an axially extending recess, the body having locking means for releasably and rotatably connecting the cutting bit to a protruding part of a bit holder, and a generally convex surface portion starting at the locking means and extending towards an entrance portion of the recess at the second end, wherein the entrance portion at a lowermost part of the recess forms a generally conical surface portion and the generally convex surface portion has an axially rounded convex surface, a radius of the convex surface portion being greater than or equal to ¼ of a distance from a base of the conical body to an innermost portion of the locking means.

2. The cutting bit as claimed in claim 1, wherein the locking means are spaced inwardly from an opening of the recess.

3. The cutting bit as claimed in claim 1, wherein a distance from the base of the conical body to the innermost portion of the locking means is less than or equal to half a total height of the generally conical body.

4. The cutting bit as claimed in claim 1, wherein the radius of the convex surface portion is less than or equal to twice a distance from the base of the conical body to the innermost portion of the locking means.

5. The cutting bit as claimed in claim 1, wherein an outer surface portion of the conical body is generally concave.

6. The cutting bit as claimed in claim 1, wherein the locking means comprise a bearing.

7. The cutting bit as claimed in claim 1, wherein the cutting point is at least coated with a super hard material, or a combination of super hard materials.

8. A bit holder for a cutting bit, comprising:

a holder body; and a protruding part extending from the holder body, and being adapted to extend into a recess of a cutting bit, the cutting bit having a generally conical body, a first end of which forming a cutting point and a second end of which forming an axially extending recess, the body having locking means positioned on the protruding part for releasably and rotatably locking the cutting bit to the bit holder, and a generally convex surface portion starting at the locking means and extending towards an entrance portion at a lowermost part of the recess at the second end, the protruding part forming a concave surface portion that abuts against the convex surface portion of the cutting bit, wherein the holder has a shoulder portion forming a generally conical surface portion for interaction with the entrance portion of the cutting bit and the concave surface portion having an axially rounded concave surface, a radius of the convex surface portion being greater than or equal to ¼ of a distance from a base of the conical body to an innermost portion of the locking means.

9. The bit holder as claimed in claim 8, wherein the bit holder is permanently secured to a drive body.

10. The bit holder as claimed in claim 8, wherein the protruding part and the holder body are formed in one piece.

11. A system comprising:

a cutting bit having a generally conical body, a first end of which forming a cutting point and a second end of which forming an axially extending recess;

a bit holder including a holder body, and a protruding part extending from the holder body and extending into a recess of the cutting bit; and locking means positioned on the protruding part for releasably and rotatably locking the cutting bit to the bit holder, the cutting bit body having a generally convex surface portion starting at the locking means and extending towards an entrance portion at a lowermost part of the recess at the second end, the protruding part forming a concave surface portion that abuts against the generally convex surface portion of the cutting bit, wherein the holder has a shoulder portion forming a generally conical surface portion for interaction with the entrance portion of the cutting bit and the generally concave surface portion having an axially rounded concave surface, a radius of the convex surface portion being greater than or equal to ¼ of a distance from a base of the conical body to an innermost portion of the locking means.

12. The system as claimed in claim 11, wherein the second end of the cutting bit extends radially beyond a bit facing surface of the bit holder.

13. The system as claimed in claim 11, wherein the entrance portion extends axially beyond the shoulder portion when the cutting bit is connected to the bit holder.

* * * * *